US008708677B2

(12) United States Patent
Gotou et al.

(10) Patent No.: US 8,708,677 B2
(45) Date of Patent: Apr. 29, 2014

(54) SCREW COMPRESSOR HAVING INJECTION HAVING INJECTION MECHANISM THAT INJECTS OIL OR REFRIGERANT TOWARD A STARTING END OF AN EXTENDING DIRECTION OF A HELICAL GROOVE OF THE FEMALE ROTOR OR THE MALE ROTOR

(75) Inventors: Nozomi Gotou, Sakai (JP); Hideyuki Gotou, Dartford (GB); Harunori Miyamura, Dartford (GB); Hideki Fujiwara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 342 days.

(21) Appl. No.: 12/864,087

(22) PCT Filed: Jan. 23, 2009

(86) PCT No.: PCT/JP2009/000266

§ 371 (c)(1),
(2), (4) Date: Jul. 22, 2010

(87) PCT Pub. No.: WO2009/093469

PCT Pub. Date: Jul. 30, 2009

(65) Prior Publication Data

US 2010/0329918 A1 Dec. 30, 2010

(30) Foreign Application Priority Data

Jan. 23, 2008 (JP) ..... 2008-012350

(51) Int. Cl.

| | |
|---|---|
| ***F03C 4/00*** | (2006.01) |
| ***F04C 2/00*** | (2006.01) |
| ***F04C 18/00*** | (2006.01) |

(52) U.S. Cl.
USPC ..... 418/195; 418/15; 418/91; 418/99; 418/201.1

(58) Field of Classification Search
USPC ..... 418/15, 194–195, 201.1, 206.1, 206.8, 418/91, 99
See application file for complete search history.

(56) References Cited

U.S. PATENT DOCUMENTS 4,070,166 A * 1/1978 Emanuelsson ..... 418/85
5,174,741 A * 12/1992 Tohgo ..... 418/84

FOREIGN PATENT DOCUMENTS

| | | | | |
|---|---|---|---|---|
| JP | 02-248678 A | | 10/1990 | |
| JP | 05-106572 A | | 4/1993 | |
| JP | 09-151870 A | | 6/1997 | |
| JP | 2004162540 A | * | 6/2004 | ..... F04C 18/16 |
| JP | 2008-267222 A | | 11/2008 | |

* cited by examiner

*Primary Examiner* — Theresa Trieu
(74) *Attorney, Agent, or Firm* — Global IP Counselors

(57) ABSTRACT

A screw compressor includes a screw rotor, a gate rotor and an injection mechanism. The screw rotor is provided with multiple helical grooves. The gate rotor is provided with multiple gates meshing with the helical grooves to form at least one compression chamber between at least one of the helical grooves and at least one of the gates. The compression chamber is configured and arranged such that refrigerant taken-in from a starting-end side of the helical groove is compressed and discharged from a dead-end side of the helical groove. The injection mechanism is configured and arranged to inject oil or refrigerant from a discharge hole of the injection mechanism into the compression chamber such that rotational torque is imparted in a direction in which the screw rotor is rotated at a time of compression.

4 Claims, 10 Drawing Sheets

(A)

(B)

(A)

(B)

SCREW COMPRESSOR HAVING INJECTION HAVING INJECTION MECHANISM THAT INJECTS OIL OR REFRIGERANT TOWARD A STARTING END OF AN EXTENDING DIRECTION OF A HELICAL GROOVE OF THE FEMALE ROTOR OR THE MALE ROTOR

CROSS-REFERENCE TO RELATED APPLICATIONS

This U.S. National stage application claims priority under 35 U.S.C. §119(a) to Japanese Patent Application No. 2008-012350, filed in Japan on Jan. 23, 2008, the entire contents of which are hereby incorporated herein by reference.

TECHNICAL FIELD

The present invention relates to screw compressors in which oil or refrigerant is injected into compression chambers.

BACKGROUND ART

Conventionally, as compressors for compressing refrigerant or air, there have been known single-screw compressors including one screw rotor, a casing for accommodating the screw rotor, and two gate rotors (refer to Japanese Patent Publication No. H02-248678 A).

In the screw compressors, compression chambers are formed by meshing gates of the gate rotors with helical grooves of the screw rotor, and refrigerant is compressed by rotation of the screw rotor and the gate rotors. In this context, oil is injected into the compression chambers for the purpose of lubricating the helical grooves and the gates and enhancing sealability of gaps between the helical grooves and the gates.

In addition, there have been known other screw compressors in which liquid refrigerant, other than oil, is injected into compression chambers or in which intermediate-pressure refrigerant is injected into compression chambers.

SUMMARY

Technical Problem

However, in the configuration of injecting oil or refrigerant (hereinafter, also referred to as oil and the like) into compression chambers, there is a risk that injected oil and the like resists the rotated screw rotor and causes mechanical loss.

The present invention has been made in view of such circumstances, and an object of the present invention is to prevent mechanical loss from increasing at a time of injecting oil or refrigerant into compression chambers.

Solution To The Problem

A screw compressor according to a first aspect of the present invention includes the following: a screw rotor (40) provided with multiple helical grooves (41, 41, . . . ); and a gate rotor (50A, 50B) provided with multiple gates (51, 51, . . . ) which mesh with the helical grooves (41, 41, . . . ), in which, in a compression chamber (23) formed with the helical groove (41) and the gate (51), refrigerant taken-in from a starting-end side of the helical groove (41) is compressed and discharged from a dead-end side of the helical groove (41). The screw compressor further includes an injection mechanism (3) for injecting oil or refrigerant from a discharge hole (31*a*) thereof into the compression chamber (23). The injection mechanism (3) injects oil or refrigerant to the screw rotor (40) such that rotational torque is imparted in a direction in which the screw rotor (40) is rotated at a time of compression.

In the configuration described above, oil and the like injected from the injection mechanism (3) imparts the rotational torque for the rotation in the rotational direction at the time of compression (hereinafter, also referred to as compression rotational direction) to the screw rotor (40). Thus, injected oil and the like do not resist the rotation of the screw rotor (40) at the time of compression, but support the rotation thereof. As a result, mechanical loss is prevented from increasing, and efficiency of the screw compressor can be enhanced.

According to a second aspect of the present invention, in the screw compressor according the first aspect of invention, the injection mechanism (3) injects oil or refrigerant to a region of the screw rotor (40) being rotated in which region the helical grooves (41, 41, . . . ) move in a direction of moving away from the discharge hole (31*a*).

In the configuration described above, if the rotated screw rotor (40) is divided on a plane including an axis (X) thereof and the discharge hole (31*a*) of the respective injection mechanism (3), the screw rotor (40) is rotated in such a manner that the helical grooves (41, 41, . . . ) come close to the discharge hole (31*a*) in one region, and the screw rotor (40) is rotated in such a manner that the helical grooves (41, 41, . . . ) move in a manner of moving away from the discharge hole (31*a*) in the other region. Of the two regions, the injection mechanism (3) injects oil and the like to the one region in which the helical grooves (41, 41, . . . ) move in a manner of moving away from the discharge hole (31*a*). With this, a component in a tangential direction of an impact of oil and the like injected from the injection mechanism (3) and struck to the screw rotor (40) corresponds to the compression rotational direction of the screw rotor (40). Thus, the rotational torque in the compression rotational direction can be imparted to the screw rotor (40). As a result, mechanical loss is prevented from increasing, and efficiency of the screw compressor can be enhanced.

According to a third aspect of the present invention, in the screw compressor according the first or second aspects of invention, the injection mechanism (3) injects oil or refrigerant toward, relative to a perpendicular line dropped from the discharge hole (31*a*) to the axis (X) of the screw rotor (40), an end portion on a discharge side of the screw rotor (40) in an axial direction of the screw rotor (40).

In the configuration described above, when the helical grooves (41, 41, . . . ) are observed from a point outside of an outer peripheral of the screw rotor (40), for example, from a point of the discharge hole (31*a*) at the time of the rotation of the screw rotor (40), the helical grooves (41, 41, . . . ) appear to move from an end portion on an intake side to an end portion on a discharge side in the axial direction of the screw rotor (40). In other words, by injecting oil and the like from the injection mechanism (3) in a direction inclined toward, relative to a perpendicular line dropped from the discharge hole (31*a*) to the axis (X) of the screw rotor (40), the end portion on the discharge side in an axial direction of the screw rotor (40), rotational torque in such a direction that the helical grooves (41, 41, . . . ) are moved from the end portion on the intake side to the end portion on the discharge side in the axial direction of the screw rotor (40), that is, in the compression rotational direction can be imparted to the screw rotor (40).

A screw compressor according to a fourth aspect of the present invention includes the following: a screw rotor (40) provided with multiple helical grooves (41, 41, . . . ); and a gate rotor (50A, 50B) provided with multiple gates (51, 51, . . . ) which mesh with the helical grooves (41, 41, . . . ), in which, in a compression chamber (23) formed with the helical groove (41) and the gate (51), refrigerant taken-in from a starting-end side of the helical groove (41) is compressed and discharged from a dead-end side of the helical groove (41). The screw compressor further includes an injection mechanism (3) for injecting oil or refrigerant from a discharge hole (31*a*) thereof into the compression chamber (23). The injection mechanism (3) injects oil or refrigerant to one sidewall surface (42) of sidewall surfaces (42, 43) of the helical groove (41), the one sidewall surface (42) being formed on a forward side of an advance direction of the gate (51) meshing with the helical groove (41).

As described above, when the helical grooves (41, 41, . . . ) are observed from a point outside of the outer peripheral of the screw rotor (40) at the time of the rotation of the screw rotor (40), the helical grooves (41, 41, . . . ) appear to move from an end portion on an intake side to an end portion on a discharge side in the axial direction of the screw rotor (40). The movement direction corresponds to the advance direction in which the gates (51, 51, . . . ) meshing with the helical grooves (41, 41, . . . ) move by the rotation of the screw rotor (40). In other words, by applying the impact of oil and the like on the one sidewall surface (42) of the sidewall surfaces (42, 43) of the helical groove (41), the one sidewall surface (42) being formed on the forward side of the advance direction of the gates (51, 51, . . . ), the screw rotor (40) rotated in the compression rotational direction is prevented from being hindered. As a result, mechanical loss is prevented from increasing. In addition, the rotational torque in the compression rotational direction can be imparted to the screw rotor (40), whereby efficiency of the screw compressor can be enhanced.

A screw compressor according to a fifth aspect of the present invention includes the following: a screw rotor (40) provided with multiple helical grooves (41, 41, . . . ); and a gate rotor (50A, 50B) provided with multiple gates (51, 51, . . . ) which mesh with the helical grooves (41, 41, . . . ), in which, in a compression chamber (23) formed with the helical groove (41) and the gate (51), refrigerant taken-in from a starting-end side of the helical groove (41) is compressed and discharged from a dead-end side of the helical groove (41). The screw compressor further includes an injection mechanism (303) for injecting oil or refrigerant from a discharge hole (331*a*) thereof into the compression chamber (23). The injection mechanism (303) injects oil or refrigerant toward an starting end of an extending direction in which the helical groove (41) extends.

In the configuration described above, the screw rotor (40) is rotated such that the helical grooves (41, 41, . . . ) mesh with the gate rotor from the starting-end side thereof and are separated from the gate rotor at the dead-end side thereof. That is, the screw rotor (40) is rotated from the dead-end side to the starting-end side of the helical grooves (41, 41, . . . ). In this context, in the configuration in which the injection mechanism (303) injects oil and the like to the screw rotor (40), by injecting oil or refrigerant toward the starting end of the extending direction of the helical groove (41), the rotation of the screw rotor (40) in the compression rotational direction is prevented from being hindered. As a result, mechanical loss is prevented from increasing. In addition, the rotational torque in the compression rotational direction can be imparted to the screw rotor (40), whereby efficiency of the screw compressor can be enhanced.

Advantages of the Invention

According to the first aspect of the present invention, the screw compressor is configured such that oil from the injection mechanism (3) is injected in the direction of imparting rotational torque in the compression rotational direction to the screw rotor (40). With this configuration, mechanical loss at the time of rotation of the screw rotor (40) can be reduced which is caused by oil and the like injected into the compression chambers. In addition, rotational torque is imparted, whereby efficiency of the screw compressor can be enhanced.

According to the second aspect of the present invention, the screw compressor is configured such that oil from the injection mechanism (3) is injected to the region of the rotated screw rotor (40) in which region the helical grooves (41, 41, . . . ) move in the direction of moving away from the discharge holes (31*a*, 31*a*). With this configuration, rotational torque can be imparted in a rotational direction in which the helical grooves (41, 41, . . . ) move in the direction of moving away from the discharge holes (31*a*, 31*a*), that is, in the very direction in which the screw rotor (40) is rotated. As a result, by the impact of the injected oil and the like, rotational torque in the compression rotational direction can be imparted to the screw rotor (40).

According to the third aspect of the present invention, the screw compressor is configured such that oil and the like from the injection mechanism (3) is injected toward, relative to the perpendicular line dropped from the discharge hole (31*a*) to the axis (X) of the screw rotor (40), the end portion on the discharge side of the screw rotor (40) in the axial direction of the screw rotor (40). With this configuration, an impact of oil and the like can be applied in the direction in which the helical grooves (41, 41, . . . ) move in the axial direction of the screw rotor (40) when the screw rotor (40) is rotated in the compression rotational direction. As a result, rotational torque in the compression rotational direction can be imparted to the screw rotor (40).

According to the fourth aspect of the present invention, the screw compressor is configured such that oil and the like from the injection mechanism (3) is injected to the one sidewall surface (42) of the sidewall surfaces (42, 43) of the helical groove (41), the one sidewall surface (42) being formed on the forward side of the advance direction of the gate meshing with the helical groove (41). With this configuration, an impact of oil and the like can be applied in the direction of moving the one sidewall surface (42) the helical groove (41) in the advance direction of the gate. As a result, rotational torque in the compression rotational direction can be imparted to the screw rotor (40).

According to the fifth aspect of the present invention, the screw compressor is configured such that oil and the like from the injection mechanisms (303, 303) is injected toward the starting end of the extending direction of the helical groove (41). With this configuration, an impact of oil and the like can be applied in the direction in which the helical grooves (41, 41, . . . ) are rotated from the dead-end side to the starting-end side of the screw rotor (40). As a result, rotational torque in the compression rotational direction can be imparted to the screw rotor (40).

BRIEF DESCRIPTION OF THE DRAWINGS

FIG. 5(A) illustrates an intake process, FIG. 5(B) illustrates an compression process, and FIG. 5(C) illustrates a discharge process.

FIG. 8(A) is a plan view thereof, and FIG. 8(B) is a front view thereof.

FIG. 9(A) is a plan view thereof, and FIG. 9(B) is a front view thereof.

FIG. 10(A) is a plan view thereof, and FIG. 10(B) is a front view thereof.

DESCRIPTION OF EMBODIMENTS

In the following, description is made of embodiments of the present invention with reference to drawings.

First Embodiment

Figure 2:
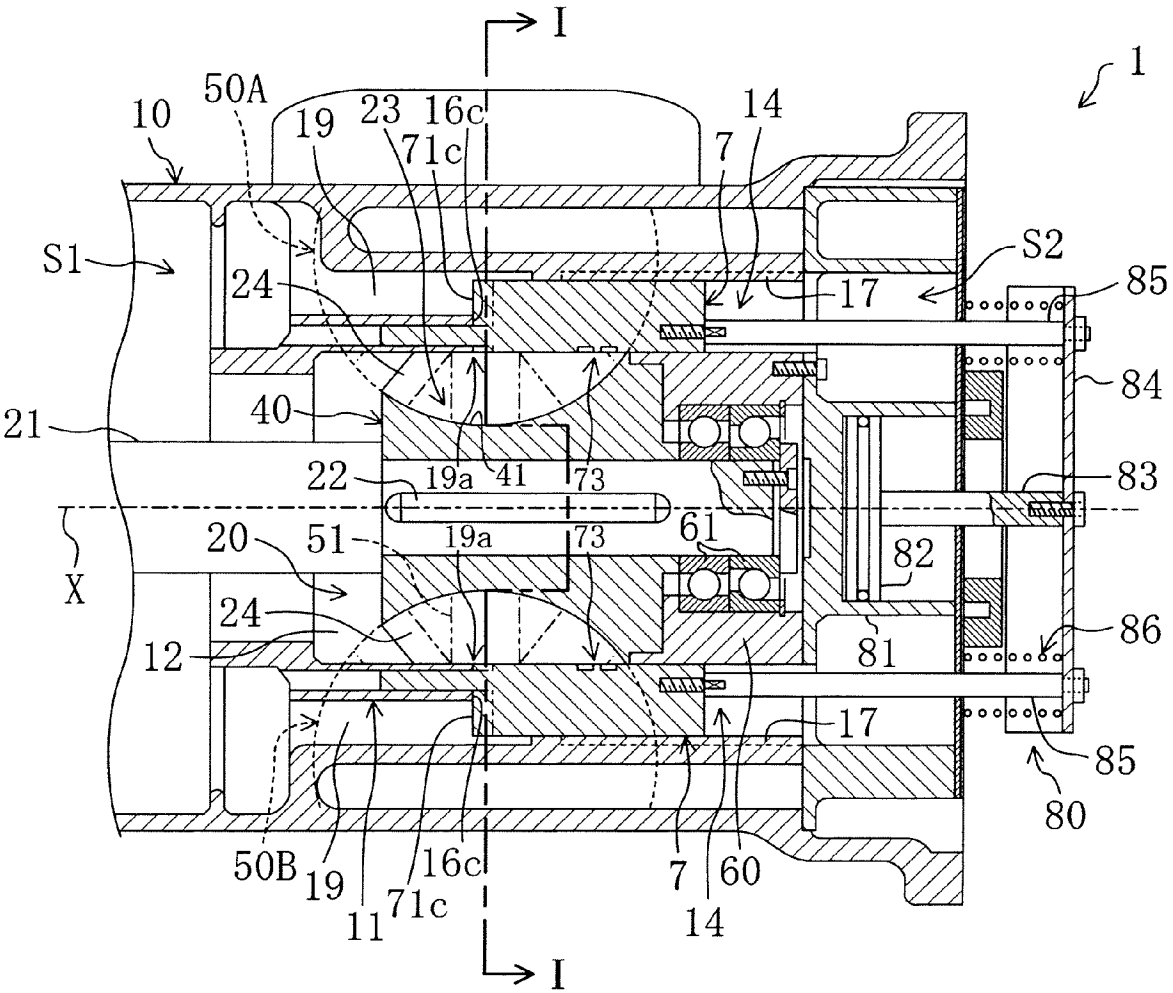
FIG. 2 is a vertical sectional view of a structure of the main portion of the screw compressor.
Figure 3:
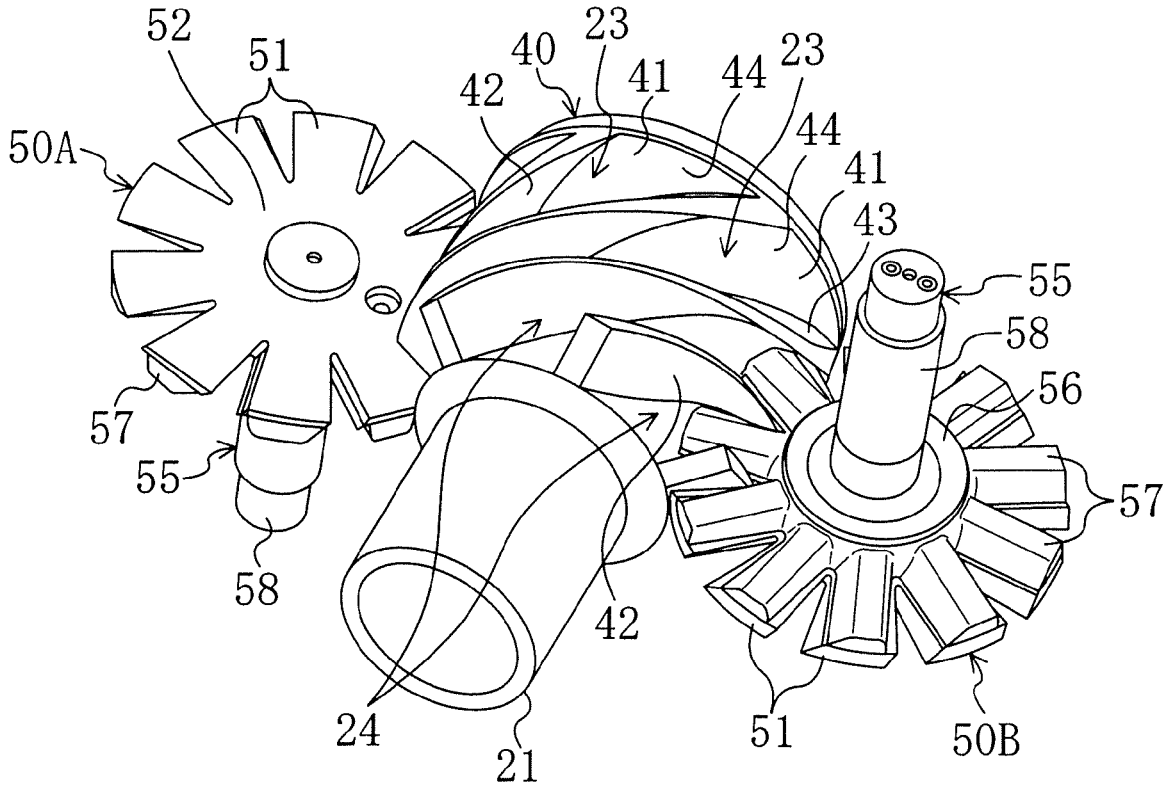
FIG. 3 is a perspective view of a screw rotor and gate rotors.

A screw compressor (1) according to a first embodiment of the present invention is provided, for the purpose of compressing refrigerant, in a refrigerant circuit which performs a refrigerant cycle. As illustrated in FIGS. 2 and 3, the screw compressor (1) has a semi-hermetic structure. In the screw compressor (1), a compression mechanism (20) and an electric motor (not shown) for driving the compression mechanism (20) are accommodated in a single casing (10). The compression mechanism (20) is coupled with the electric motor through a drive shaft (21). Further, the following are defined in the casing (10): a low-pressure space (51) into which low-pressure gas refrigerant is introduced from an evaporator of the refrigerant circuit and which guide the low-pressure gas refrigerant into the compression mechanism (20); and high-pressure spaces (S2) into which high-pressure gas refrigerant discharged from the compression mechanism (20) flows.

The compression mechanism (20) includes a single screw rotor (40), a cylindrical wall (11) constituting a part of the casing (10) and defining a screw-rotor accommodating chamber (12) for accommodating the screw rotor (40), and two gate rotors (50A, 50B) which mesh with the screw rotor (40).

Figure 4:
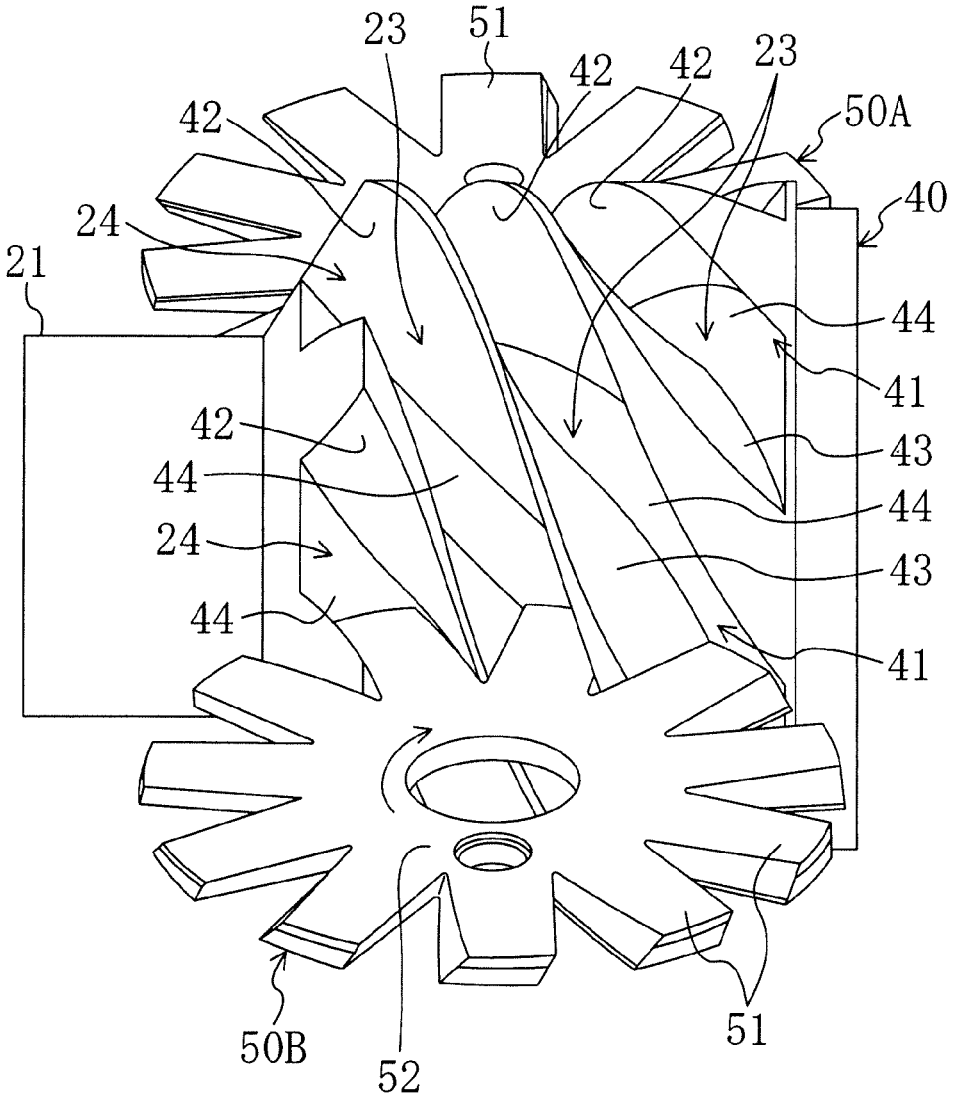
FIG. 4 is a perspective view of the screw rotor and the gate rotors from another angle.

As illustrated in FIGS. 3 and 4, the screw rotor (40) is a metal member formed substantially in a columnar shape. In an outer peripheral portion of the screw rotor (40), there are formed multiple helical grooves (41, 41, . . . ) helically extending from one end to the other end of the screw rotor (40). The multiple helical grooves (41, 41, . . . ) are arranged at equal intervals. The screw rotor (40) rotatably fits to the cylindrical wall (11), and an outer peripheral surface thereof comes in sliding contact with an inner peripheral surface of the cylindrical wall (11).

The drive shaft (21) is inserted into the screw rotor (40), and the screw rotor (40) and the drive shaft (21) are coupled with each other through a key (22). The drive shaft (21) is arranged coaxially with the screw rotor (40). A distal end portion of the drive shaft (21) is rotatably supported by a bearing holder (60) positioned on a side of the high-pressure spaces (S2) in the compression mechanism (20) (right side in a case of regarding an axial direction of the drive shaft (21) of FIG. 2 as a lateral direction). The bearing holder (60) supports the drive shaft (21) through ball bearings (61).

One end of each of the helical grooves (41) of the screw rotor (40) in an axial direction of the screw rotor (40) is a starting end (left side in FIG. 4), and the other end is a dead end (right side in FIG. 4). Further, a peripheral edge portion of the one end surface in the axial direction of the screw rotor (40) is formed as a tapered surface. In this context, whereas the starting end of each of the helical grooves (41) opens in the tapered surface, the dead end of each of the helical grooves (41) opens in the outer peripheral surface of the screw rotor (40) without opening in the other end surface in the axial direction thereof. The screw rotor (40) is fitted into the cylindrical wall (11) such that the starting-end side thereof is directed toward the low-pressure space (S1) and the dead-end side thereof is directed toward the high-pressure spaces (S2) (refer to FIG. 2). That is, starting end portions of the helical grooves (41) are exposed to the low-pressure space (S1). The starting end portions constitute intake ports (24) of the compression mechanism (20).

Each of the helical grooves (41) includes: a first sidewall surface (42) positioned on a forward side of an advance direction of gates (51) described below of each of the gate rotors (50A (50B)); a second sidewall surface (43) positioned on a rearward side of the advance direction of the gates (51); and a bottom wall surface (44).

The two gate rotors (50A, 50B) are constituted by an upward gate rotor (50A) whose front surface faces upward, and a downward gate rotor (50B) whose front surface faces downward. Each of the gate rotors (50A (50B)) is a resin member having the multiple gates (51, 51, . . . ) formed in a rectangular shape. Each of the gate rotors (50A (50B)) is attached to a metal rotor-support member (55). The rotor-support member (55) includes a base portion (56), arm portions (57), and a shaft portion (58). The base portion (56) is formed in a shape of a disk somewhat thick. The arm portions (57) are provided as many as the gates (51) of the gate rotor (50A (50B)), and extend radially outward from an outer peripheral surface of the base portion (56). The shaft portion (58) is formed in a bar-like shape and provided upright while passing through the base portion (56). A center axis of the shaft portion (58) corresponds to a center axis of the base portion (56). Each of the gate rotors (50A (50B)) is attached to surfaces of the base portion (56) and the arm portions (57) on a side opposite to the shaft portion (58). Each of the arm portions (57) is held in contact with rear surfaces of the gates (51). In this context, one end portion (58*a*) of the shaft portion (58) (hereinafter, also referred to as projecting end portion) projects from the front surface of the gate rotor (50A (50B)). Further, a rotary axis of the gate rotor (50A (50B)) corresponds to the center axis of the shaft portion (58).

As illustrated in FIG. 3, the two gate rotors (50A, 50B) are respectively accommodated in gate-rotor accommodating chambers (13, 13) arranged outside the cylindrical wall (11) axisymmetrically with respect to a rotary axis of the screw rotor (40). The gate-rotor accommodating chambers (13) communicate with the low-pressure space (S1).

A bearing housing (13*a*) constituting part of the casing (10) is arranged in the gate-rotor accommodating chamber (13). The bearing housing (13*a*) is a cylindrical member provided with a flange (13*c*) on a proximal end side thereof, and is inserted from an opening (11*a*) of the cylindrical wall (11) into the gate-rotor accommodating chamber (13). The flange (13*c*) is attached to the cylindrical wall (11). Further, a lid member (13*d*) is attached to the flange (13*c*), and the bearing housing (13*a*) is formed in a bottomed cylindrical shape.

Ball bearings (13*b*, 13*b*) are respectively provided at two upper and lower points in the bearing housing (13*a*). The ball bearings (13*b*, 13*b*) rotatably support the shaft portion (58) of the gate rotor (50B). The ball bearings (13*b*) constitute a bearing portion.

Openings (11*b*) for communicating the screw-rotor accommodating chamber (12) and the respective gate-rotor accommodating chambers (13, 13) with each other are formed through the cylindrical wall (11). In this context, the gate rotors (50A (50B)) respectively accommodated in the gate-rotor accommodating chambers (13) are arranged such that the gates (51, 51, . . . ) mesh with the helical grooves (41, 41, . . . ) of the screw rotor (40) through the openings (11*b*) of the cylindrical wall (11).

In this context, the two gate rotors (50A, 50B) are located adjacent to each other in a horizontal direction with respect to the screw rotor (40). Further, each of the gate rotors (50A (50B)) is arranged such that the front surface thereof faces a rotational direction of the screw rotor (40), that is, directed to a tangential direction of the screw rotor (40). As a result, the upward gate rotor (50A) is installed in a posture in which the shaft portion (58) is directed vertically downward whereas the front surface of the upward gate rotor (50A) is directed vertically upward, and the downward gate rotor (50B) is installed in a posture in which the shaft portion (58) is directed vertically upward whereas the front surface of the downward gate rotor (50B) is directed vertically downward.

In the compression mechanism (20), the gates (51) of the gate rotor (50A (50B)) mesh with the helical grooves (41) of the screw rotor (40). With this, compression chambers (23) are formed by closed spaces surrounded by the inner peripheral surface of the cylindrical wall (11), the helical grooves (41), and the gates (51). That is, the compression chambers (23) are formed by closing tubular spaces surrounded by the helical grooves (41) and the cylindrical wall (11), with the gates (51) from the starting-end side of and/or the dead-end side of the helical grooves (41).

The screw compressor (1) is provided with slide valves (7) as capacity control mechanisms. The slide valves (7) are provided in slide-valve accommodating chambers (14) formed of outward-swelling shape at two positions in a circumferential direction of the cylindrical wall (11). Each of the slide valves (7) has an inner surface constituting part of the inner peripheral surface of the cylindrical wall (11), and is configured to be slidable in an axial direction of the cylindrical wall (11).

In each of the slide-valve accommodating chambers (14), a discharge path (17) is formed on an outer peripheral surface side of each of the slide valves (7). The discharge paths (17) communicate with the high-pressure spaces (S2).

The slide valves (7) are provided with a discharge port (73) for communicating the compression chambers (23) and the discharge paths (17) with each other.

Further, in the casing (10), in portions on the outer peripheral surface side of the slide valves (7) and near the low-pressure space (S1), there are formed bypass paths (19) separated from the discharge paths (17). The bypass paths (19) communicate with the low-pressure space (S1).

When the slide valve (7) slides toward the high-pressure spaces (S2) (right direction in FIG. 2), an axial gap is formed between an end surface (16*c*) of the slide-valve accommodating chambers (14) and an end surface (71*c*) of the slide valves (7). The axial gap communicates with the bypass path (19), and constitutes a bypass port (19*a*) for returning refrigerant from the compression chamber (23) to the low-pressure space (S1). In accordance with movement of the slide valve (7) so as to change opening degrees of the bypass port (19*a*), capacity of the compression mechanism (20) varies.

The screw compressor (1) is provided with a slide-valve drive mechanism (80) for slide-driving the slide valves (7). The slide-valve drive mechanism (80) includes: a cylinder (81) fixed to the bearing holder (60), a piston (82) loaded in the cylinder (81), an arm (84) coupled with a piston rod (83) of the piston (82), coupling rods (85) for coupling the arm (84) and the slide valves (7) with each other, and springs (86) for biasing the arm (84) in the right direction in FIG. 2.

In the slide-valve drive mechanism (80) illustrated in FIG. 2, an inner pressure in a left space of the piston (82) (space on the screw rotor (40) side of the piston (82)) is higher than an inner pressure in a right space of the piston (82) (space on the arm (84) side of the piston (82)) in FIG. 2. In this context, the slide-valve drive mechanism (80) is configured to regulate positions of the slide valves (7) by controlling the inner pressure in the right space of the piston (82) (that is, gas pressure in the right space).

During operation of the screw compressor (1), in each of the slide valves (7), an intake pressure of the compression mechanism (20) and a discharge pressure of the compression mechanism (20) act on one and the other of the end surfaces in the axial direction thereof, respectively. Therefore, during the operation of the screw compressor (1), force in a direction of pushing the slide valves (7) toward the low-pressure space (S1) constantly acts on the slide valves (7). Accordingly, when the inner pressures in the left space and the right space of the piston (82) in the slide-valve drive mechanism (80) are changed, magnitude of force in a direction of drawing back the slide valves (7) toward the high-pressure spaces (S2) varies. As a result, the positions of the slide valves (7) vary.

Figure 1:
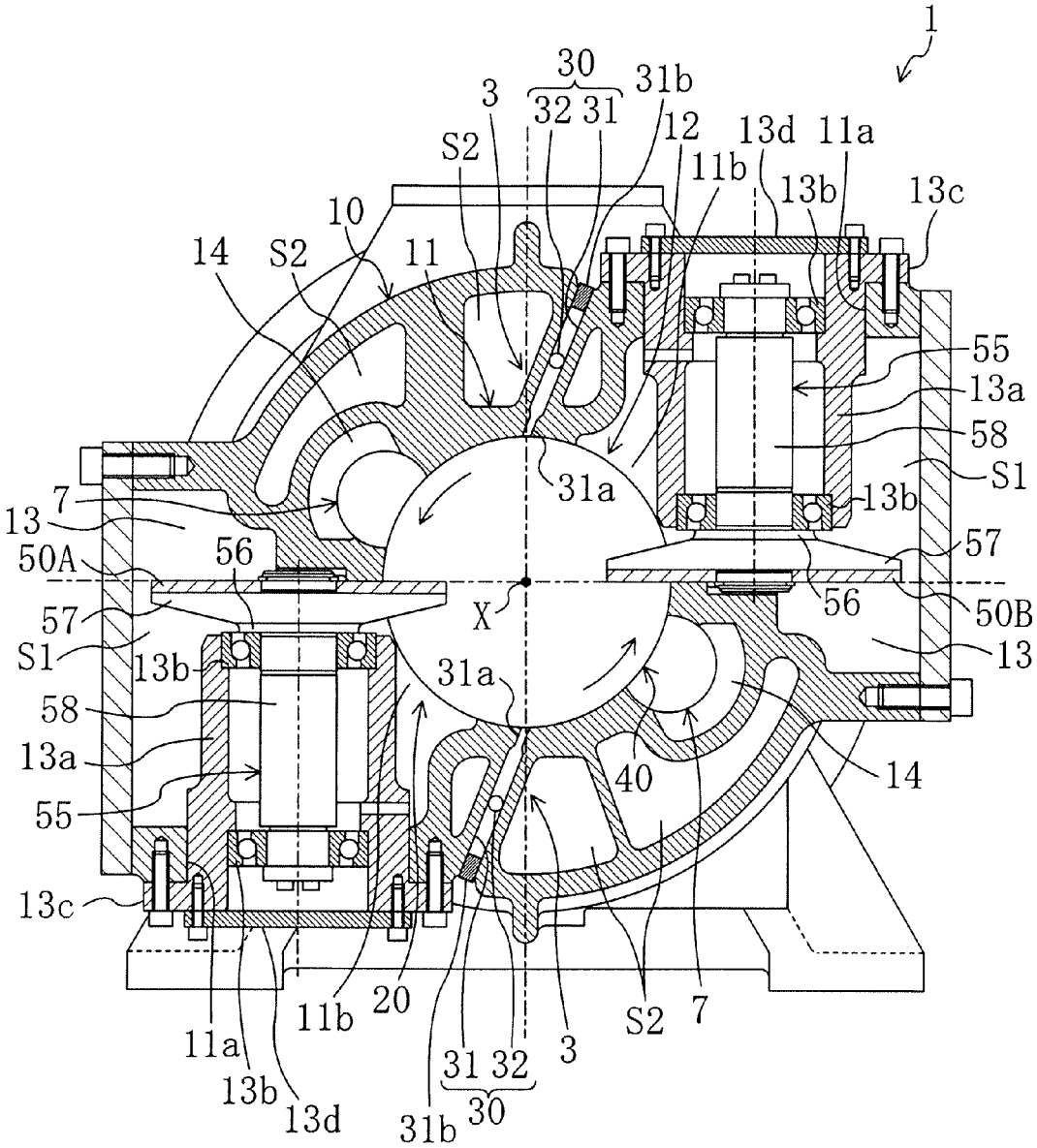
FIG. 1 is a lateral sectional view of a screw compressor according to a first embodiment of the present invention, the sectional view being taken along the line I-I in FIG. 2.

As illustrated in FIG. 1, oil-supply mechanisms (3, 3) for supplying oil to the screw rotor (40) and the respective gate rotors (50A, 50B) are formed in the cylindrical wall (11) of the casing (10). Each of the oil-supply mechanisms (3) constitutes an injection mechanism.

Specifically, each of the oil-supply mechanisms (3) includes an oil tank (not shown) for storing high-pressure oil, and an oil-supply path (30) for communicating the oil tank and the screw-rotor accommodating chamber (12) with each other.

The oil tank stores oil separated from refrigerant discharged from the compression chambers (23). The oil is in a high-pressure state due to discharge pressure of high-pressure refrigerant.

The oil-supply path (30) includes a first path (31) provided by drilling from an outside of the casing (10) and opening into the screw-rotor accommodating chamber (12), and a second path (32) extending in the axial direction in the casing (10) and having an upstream end communicating with the oil tank (not shown) and a downstream end communicating with the first path (31).

At one end portion of the first path (31) on the screw-rotor accommodating chamber (12) side, there is formed a discharge hole (31*a*) having inner diameter downsized in comparison with that of a midpoint of the first path (31) and opening to the screw-rotor accommodating chamber (12). The discharge hole (31*a*) is formed at a position which is a midpoint between the two gate rotors (50A, 50B) in the circumferential direction of the cylindrical wall (11), and opens the helical groove (41) immediately after mesh of the gate (51) (refer to FIG. 5) in the axial direction of the cylindrical wall (11).

Further, the other end portion of the first path (31) on an outer side of the casing (10) is sealed with a plug (31*b*). When viewed from the axial direction of the screw rotor (40) (that is, when viewed in lateral cross-section of the screw rotor (40) illustrated in FIG. 1), an axial line of the first path (31) is inclined, relative to a straight line connecting the discharge hole (31*a*) to the axis (X) of the screw rotor (40), toward a region of the screw rotor (40) rotated in a compression direction, in which region the helical grooves (41) move in a direction of moving away from the discharge hole (31*a*) (in other words, toward the gate rotors (50A (50B)) meshing with the helical grooves (41) from the starting-end side thereof).

Operation

Description is made of operation of the single-screw compressor (1).

When the electric motor is activated in the single-screw compressor (1), the screw rotor (40) is rotated in accordance with rotation of the drive shaft (21). The gate rotors (50A, 50B) are also rotated in accordance with the rotation of the screw rotor (40), and the compression mechanism (20) repeats the intake process, the compression process, and the discharge process. Herein, description is made of the compression chambers (23) formed in a region of from the downward gate rotor (50B) to the upward gate rotor (50A) in the rotational direction of the screw rotor (40), that is, the compression chambers (23) whose starting-end side is closed-off by the upward gate rotor (50A).

In FIG. 5(A), the helical groove (41) illustrated by hatching, that is, the intake port (24) of the compression chamber (23) opens to the low-pressure space (S1). Further, the helical groove (41) in which the compression chamber (23) is formed is meshed with the gate (51) of the downward gate rotor (50B) positioned on a lower side in FIG. 5(A). When the screw rotor (40) is rotated, the gate (51) relatively move to the dead ends of the helical grooves (41), and capacity of the compression chamber (23) is increased in accordance therewith. As a result, the low-pressure gas refrigerant in the low-pressure space (S1) is sucked into the compression chamber (23) through the intake port (24).

When being further rotated, the screw rotor (40) enters a state of FIG. 5(B). In FIG. 5(B), the compression chamber (23) illustrated by hatching becomes closed-off. In other words, the helical groove (41) in which the compression chamber (23) is formed is meshed with the gate (51) of the upward gate rotor (50A) positioned on an upper side in FIG. 5(B), and is partitioned with the gates (51) from the low-pressure space (51). Then, when the gates (51) move to the dead ends of the helical grooves (41) in accordance with the rotation of the screw rotor (40), the capacity of the compression chamber (23) is gradually reduced. As a result, the gas refrigerant in the compression chamber (23) is compressed.

When being still further rotated, the screw rotor (40) enters a state of FIG. 5(C). In FIG. 5(C), the compression chamber (23) illustrated by hatching opens to the discharge port (73), and enters a state of communicating with the high-pressure space (S2) through the discharge port (73). As a result, the compressed gas refrigerant flows out into the discharge path (17) from the discharge port (73), and flows in the discharge path (17) so as to flow out into the high-pressure space (S2). Then, the gate (51) moves to the dead ends of the helical grooves (41) in accordance with the rotation of the screw rotor (40). In accordance therewith, an opening area of the helical groove (41) to the discharge port (73) is increased, whereby the compressed gas refrigerant is pushed out from the helical groove (41).

While the intake process, the compression process, and the discharge process are performed in the compression chambers (23) in accordance with the rotation of the screw rotor (40) in this manner, high-pressure oil from the oil tank are supplied into the compression chambers (23, 23) through the oil-supply mechanisms (3, 3).

Figure 5:
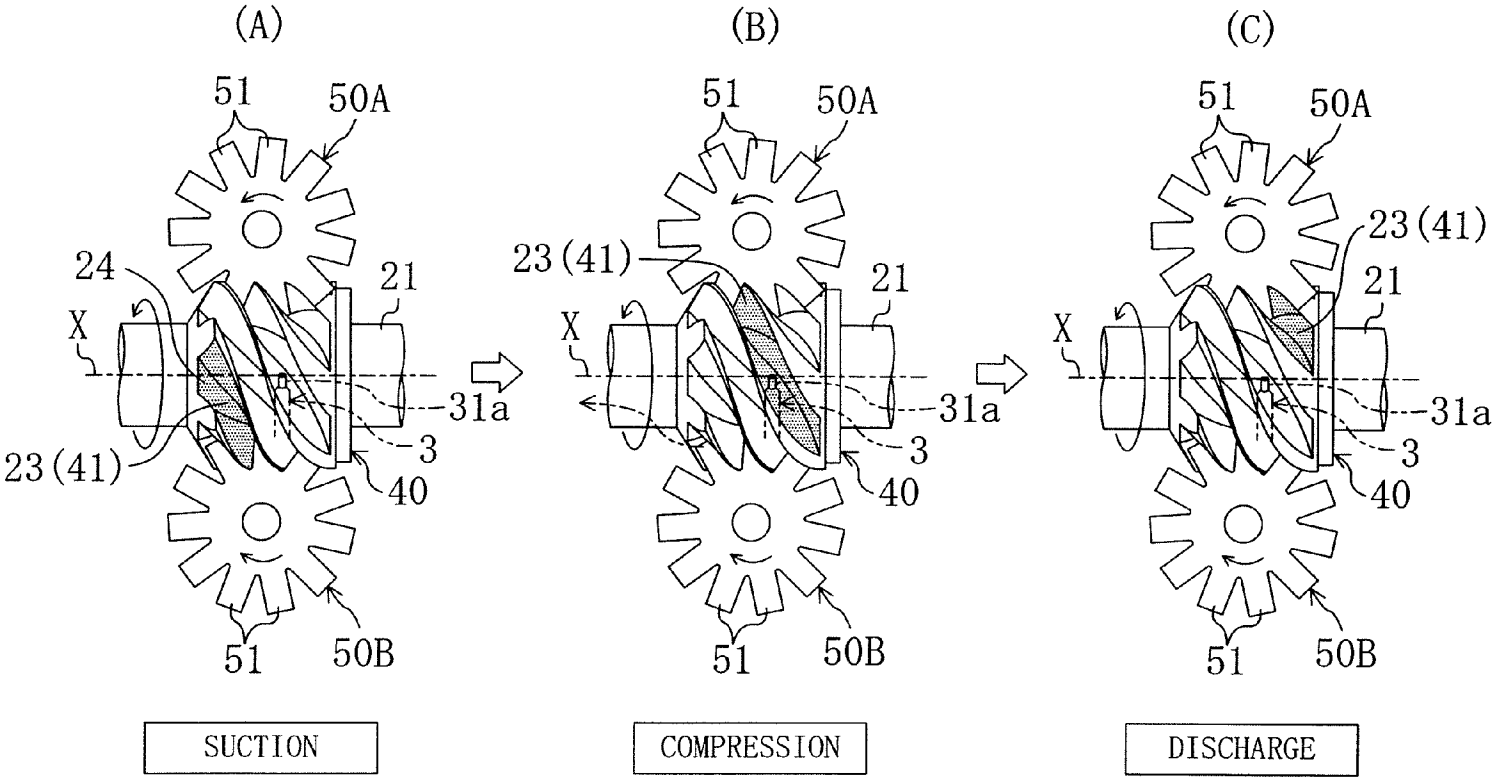
FIG. 5 are plan views illustrating operation of a compression mechanism according to the first embodiment.

Specifically, as illustrated in FIG. 5, the compression chamber (23) relatively move from the starting-end side to the dead-end side of the helical grooves (41) in the axial direction of the screw rotor (40) in accordance with the rotation of the screw rotor (40). Immediately after being closed-off by the gate (51), the compression chamber (23) which moves in this manner arrives at the position of the discharge hole (31*a*) opening in the cylindrical wall (11) (refer to FIG. 5(B)). An intake pressure in the compression chamber (23) immediately after being closed-off is equal to an intake pressure in the low-pressure space (S1). As a result, owing to a differential pressure between the high pressure in the oil tanks and the intake pressure in the compression chamber (23), the oil in the oil tanks passes through the second path (32) and the first path (31) and then is injected into the compression chamber (23) from the discharge hole (31*a*). The oil injected into the compression chamber (23) is sprayed to wall surfaces of the helical groove (41) and the inner peripheral surface of the cylindrical wall (11), and flows through the compression chamber (23) to the gate (51), with the result of being sprayed also to the gate (51). With this, the helical groove (41) and the gate (51) are lubricated, and a gap between the helical groove (41) and the gate (51) is filled with the oil, to thereby enhance sealability.

In this case, an injection direction of the oil injected from the discharge hole (31*a*) is directed to the region of the screw rotor (40) rotated in the compression direction, in which region the helical grooves (41) move in the direction of moving away from the discharge hole (31*a*) (in other words, toward the gate rotor (50A (50B)) meshing with the helical groove (41) from the starting-end side thereof)(refer to FIG. 1). Thus, the oil injected into the compression chamber (23) flows in a direction substantially the same as a compression rotational direction of the screw rotor (40). Further, when the oil injected from the discharge hole (31*a*) strikes the screw rotor (40), an impact thereof includes a component in the compression rotational direction of the screw rotor (40). In other words, rotational torque in the compression rotational direction of the screw rotor (40) can be imparted by the impact of the oil.

Thus, according to this embodiment, the oil injected into the compression chamber (23) is prevented from hindering the rotation of the screw rotor (40) at the time of compression by setting the injection direction of the oil injected from the discharge hole (31*a*) to be directed to the region of the screw rotor (40) rotated in the compression rotational direction, in which region the helical grooves (41) move in the direction of moving away from the discharge hole (31*a*). That is, mechanical loss of the screw compressor (1) is prevented from increasing.

Further, when the oil injected from the discharge hole (31*a*) strikes the screw rotor (40), rotational torque for the rotation in the compression rotational direction is imparted to the screw rotor (40). Thus, efficiency of the screw compressor (1) can be enhanced.

Note that, when the discharge hole (31*a*) opens to the compression chamber (23) (that is, when the discharge hole (31*a*) is not closed by an outermost peripheral surface of the screw rotor (40) (by a ridge portion between two adjacent helical grooves (41, 41))), it is preferred that the injection direction of the oil be set such that the oil injected from the discharge hole (31*a*) is directed to, of the side walls (42, 43) of the helical groove (41), the first sidewall surface (42) positioned on the forward side of the advance direction of the gates (51). When the helical grooves (41) are observed from a point on an outer side of the screw rotor (40), for example, from a point of the discharge hole (31*a*) at the time of the rotation of the screw rotor (40) in the compression rotational direction, the helical grooves (41) appear to move from an end portion on an intake side to an end portion on a discharge side in the axial direction of the screw rotor (40). The direction of from the intake-side end portion to the discharge-side end portion in the axial direction of the screw rotor (40) substantially corresponds to the direction to the forward side of the advance direction of the gates (51). In other words, by injecting oil to the first sidewall surface (42), an impact component for moving the helical grooves (41) to the forward side of the advance direction of the gates (51), that is, for moving the helical grooves (41) in the direction of from the intake-side end portion to the discharge-side end portion in the axial direction of the screw rotor (40) can be imparted to the screw rotor (40). That is, rotational torque for rotating the screw rotor (40) in the compression rotational direction can be imparted.

Note that, while the discharge hole (31*a*) opens to the compression chamber (23), it is unnecessary to constantly inject oil to the first sidewall surface (42). It is only necessary to inject oil to the first sidewall surface (42) at least when the discharge hole (31*a*) which opens to the compression chamber (23) is positioned at the center in a groove width direction of the helical groove (41). With this, almost while the discharge hole (31*a*) opens to the compression chamber (23), oil is injected to the first sidewall surface (42), whereby rotational torque in the compression rotational direction can be imparted to the screw rotor (40).

In addition, while oil is not directed to the first sidewall surface (42), it is preferred that the oil be injected to the bottom wall surface (44) and be not injected to the second sidewall surface (43). That is, it is only necessary that the injection direction of oil injected from the discharge hole (31*a*) is set as follows: immediately after the discharge hole (31*a*) closed by the ridge portion between the two adjacent helical grooves (41, 41) opens to the compression chamber (23) in accordance with relative parallel movement of the helical grooves (41) and the discharge hole (31*a*) in accordance with the rotation of the screw rotor (40), oil is injected to the first sidewall surface (42). Even when the relative movement of the helical grooves (41) and the discharge hole (31*a*) continue, the oil continues being directed to the first sidewall surface (42) for a while. The oil is soon directed to the bottom wall surface (44). After that, the discharge hole (31*a*) is re-closed by the ridge portion between the two adjacent helical grooves (41, 41). That is, by setting a position of the discharge hole (31*a*) and an injection angle from the discharge hole (31*a*) such that, while the discharge hole (31*a*) is open to the compression chamber (23), the oil is injected to any one of the first sidewall surface (42) and the bottom wall surface (44) and that the oil is not injected to the second sidewall surface (43), at least, the rotation of the screw rotor (40) at the time of compression is prevented from being hindered. In some cases, rotational torque in the compression rotational direction can be imparted to the screw rotor (40). Therefore, efficiency of the screw compressor (1) can be enhanced.

Note that, the first and second oil-supply paths (31, 32) may be arranged otherwise than the arrangement described above. That is, the discharge hole (31*a*) is not necessarily positioned at a midpoint between the two gate rotors (50A, 50B) in the circumferential direction of the cylindrical wall (11), and may be set to any position in the circumferential direction. Further, the axial line of the first path (31) may be inclined at any angle as long as oil injected from the discharge hole (31*a*) is directed to the region of the screw rotor (40) rotated in the compression rotational direction, in which region the helical grooves (41) move in the direction of moving away from the discharge hole (31*a*).

Second Embodiment

Next, description is made of a screw compressor (201) according to a second embodiment of the present invention.

The screw compressor (201) according to the second embodiment has oil-supply mechanisms (203) provided at different positions as those of the oil-supply mechanisms (3) according to the first embodiment. In this context, the components same as those in the first embodiment are denoted by the same reference symbols such that the description thereof is omitted, and description is made mainly of a different configuration.

Figure 6:
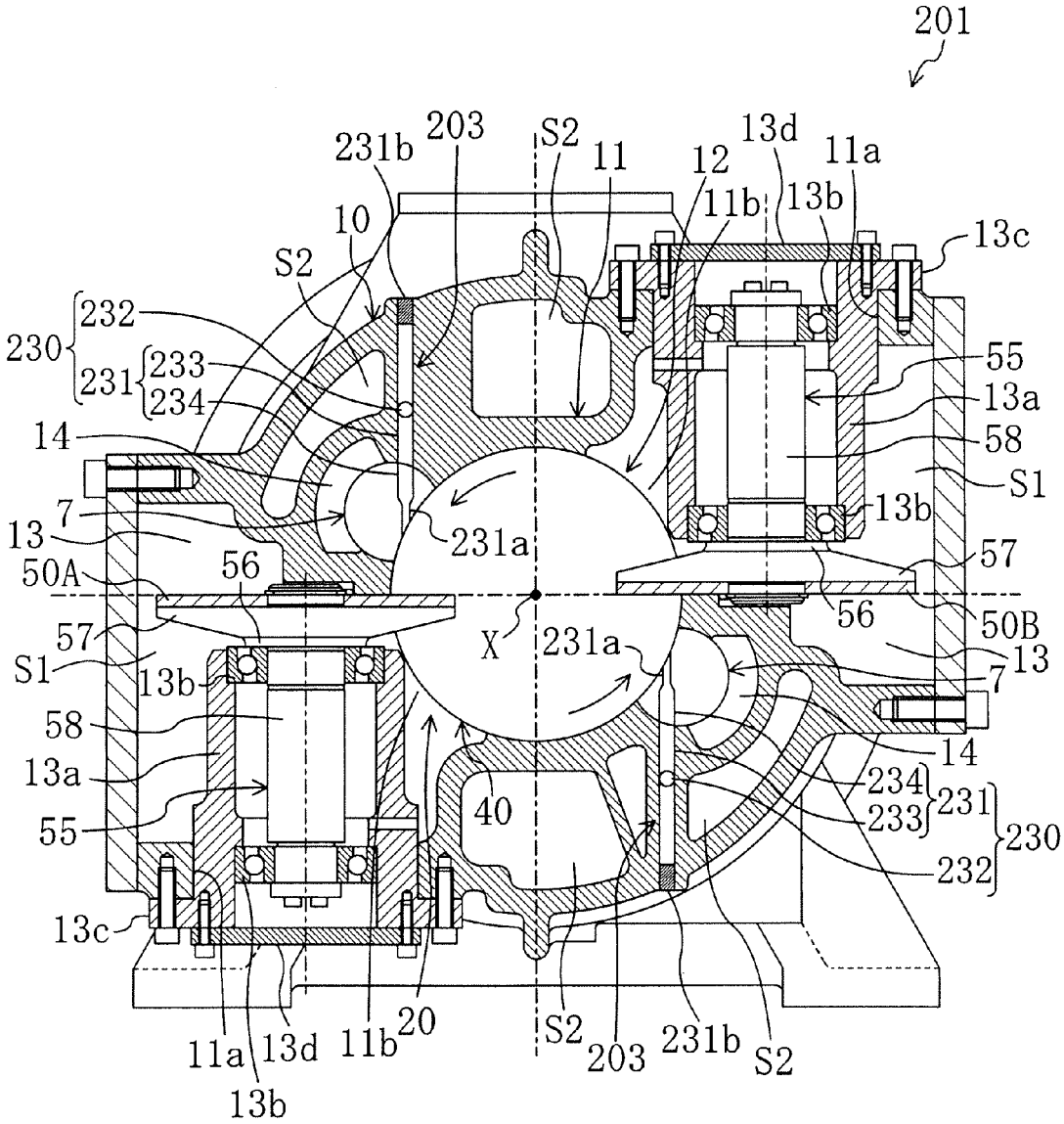
FIG. 6 is a lateral sectional view of a screw compressor according to a second embodiment, the lateral sectional view corresponding to FIG. 1.

As illustrated in FIG. 6, the oil-supply mechanism (203) according to the second embodiment has a discharge hole (231*a*) formed near the gate rotor (50A (50B)). That is, the oil-supply mechanism (203) is configured to inject oil to meshing portions between the gates (51) and the helical grooves (41).

Specifically, a first path (231) is formed such that axial lines thereof extend, parallel to a tangential direction of the screw rotor (40) at a meshing position of the gate (51) and the helical groove (41), at a radially inner position relative to the outer peripheral surface of the screw rotor (40) (that is, relative to an outer peripheral surface of the ridge portion between two adjacent helical grooves (41, 41)) at the meshing position.

Note that, the slide valve (7) exists at the position. Thus, the first path (231) includes a casing-side path (233) formed by passing through the casing (10), and a valve-side path (234) formed by passing through the slide valve (7) and communicating with the casing-side path (233). A discharge hole (231*a*) is formed at a downstream end of the valve-side path (234).

In this context, the slide valve (7) moves in the axial direction of the screw rotor (40), and hence the downstream end of the casing-side path (233) and/or an upstream end of the valve-side path (234) is enlarged in the axial direction of the screw rotor (40). (The end portions are not necessarily formed in a shape of an elongated hole, but may be merely increased in diameter.) With this, even when the slide valve (7) moves, the casing-side path (233) and the valve-side path (234) are maintained to communicate with each other.

Even in this configuration, as in the first embodiment, the axial line of the first path (231) is inclined, relative to a straight line connecting the discharge hole (231*a*) to the axis (X) of the screw rotor (40), toward a region of the screw rotor (40) rotated in the compression direction, in which region the helical grooves (41) move in a direction of moving away from the discharge hole (231*a*) when viewed from the axial direction of the screw rotor (40).

Therefore, the second embodiment provides the same functions and advantages as those according to the first embodiment.

In addition, oil injected from the discharge hole (231*a*) is sprayed directly to the meshing portions of the gates (51) and the helical grooves (41). Thus, the gates (51) and the helical grooves (41) can be reliably lubricated, and the gaps between the gates (51) and the helical grooves (41) can be reliably sealed.

Third Embodiment

Next, description is made on a screw compressor (301) according to a third embodiment.

The screw compressor (301) according to the third embodiment has oil-supply mechanisms (303) provided at different positions as those of the oil-supply mechanisms (3) according to the first embodiment. In this context, the components same as those in the first embodiment are denoted by the same reference symbols such that the description thereof is omitted, and description is made mainly of a different configuration.

Figure 7:
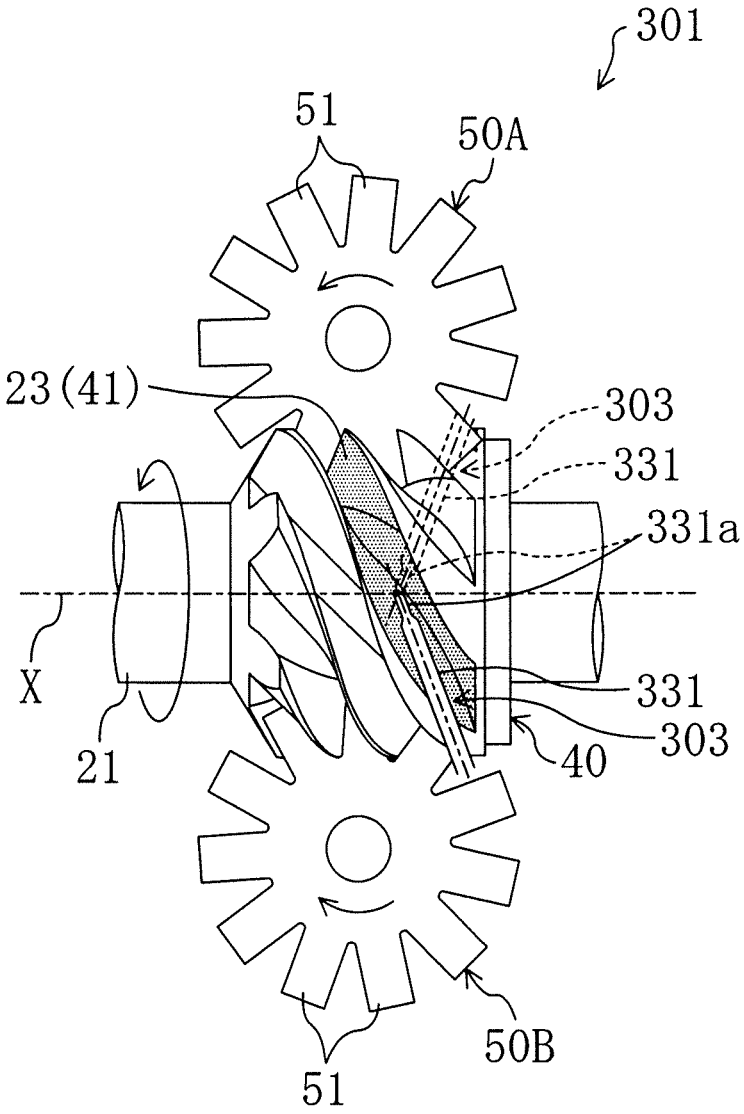
FIG. 7 is a plan view of a screw rotor and gate rotors of a screw compressor according to a third embodiment.

As illustrated in FIG. 7, the oil-supply mechanism (303) according to the third embodiment is configured such that oil injected from discharge hole (331*a*) is directed toward the starting end of the extending direction of the helical grooves (41).

As in the first embodiment, the discharge hole (331*a*) of the first path (331) is formed a position which is a midpoint between the two gate rotors (50A, 50B) in the circumferential direction of the cylindrical wall (11), and opens the helical groove (41) immediately after mesh of the gate (51) in the axial direction of the cylindrical wall (11).

In this context, the first path (331) is configured such that the axial line thereof extends in the extending direction of the helical groove (41) at a position of the discharge hole (331*a*) and that oil is injected toward the starting end of the helical groove (41).

In other words, when the screw rotor (40) is rotated, the helical groove (41) meshes with the gate (51) from the starting-end side thereof and are separated from the gate (51) at the dead-end side thereof That is, the screw rotor (40) is rotated from the dead-end side to the starting-end side of the helical groove (41) at the time of compression. Thus, as described above, by injecting oil from the discharge hole (331*a*) of the oil-supply mechanism (303) toward the starting end in the extending direction of the helical groove (41), the oil can be injected along the compression rotational direction of the screw rotor (40). As a result, mechanical loss caused by injection of oil into the compression chamber (23) is prevented from increasing. In addition, rotational torque can be imparted to the screw rotor (40) in a direction of from the dead-end side to the starting-end side of the helical groove (41), and hence efficiency of the screw compressor (1) can be enhanced.

Note that, in this case, the axial line of the first path (331) may extend to the bottom wall surface (44) of the helical groove (41), or may extend to the inner peripheral surface side of the cylindrical wall (11) relative to a tangential line drawn from the discharge hole (331*a*) to the bottom wall surface (44).

When the axial line of the first path (331) extend to the bottom wall surface (44) of the helical groove (41), oil injected from the discharge hole (331*a*) strikes the bottom wall surface (44) of the helical groove (41), and rotational torque can be positively imparted to the screw rotor (40) owing to a component in a tangential direction of an impact of the oil.

Meanwhile, when the axial line of the first path (331) extends to the inner peripheral surface side of the cylindrical wall (11) relative to the tangential line drawn from the discharge hole (331*a*) to the bottom wall surface (44), oil injected from the discharge hole (331*a*) first strikes the inner peripheral surface of the cylindrical wall (11), and then flows in the compression chamber (23) to the starting-end side of the helical groove (41). Friction of the oil against the helical groove (41) at the time of flowing causes rotational torque to be imparted to the screw rotor (40). In other words, in the configuration described above, importance is placed on how to prevent injection of oil into the compression chamber (23) from hindering the rotation of the screw rotor (40) at the time of compression, and secondarily, rotational torque is imparted to the screw rotor (40), whereby efficiency of the screw compressor (301) can be enhanced.

Other Embodiments

The following configurations may be adopted to the embodiments according to the present invention.

That is, although the screw compressors according to the first to third embodiments are configured such that oil is injected into the compression chambers (23), this should not be construed restrictively. For example, the same configuration can be adopted even for so-called economizer-type screw compressors in which gas refrigerant with an intermediate pressure is injected into compression chambers (23). Alternatively, the same configuration can be adopted even for screw compressors in which liquid refrigerant is injected into the compression chambers (23).

Note that, in the first and second embodiments, although the axial lines of the first paths (31, 231), that is, the injection directions from the discharge holes (31*a*, 231*a*) extend on the plane perpendicular to the axis of the screw rotor (40), this should not be construed restrictively. For example, the injection directions may be inclined relative to the perpendicular lines dropped respectively from the discharge holes (31*a*, 231*a*) to the axis (X) of the screw rotor (40) such that an upstream side of the injection directions is positioned on an intake end-portion side in the axial direction of the screw rotor (40) and that a downstream side of the injection directions is positioned on a discharge end-portion side in the axial direction of the screw rotor (40). That is, as described above, the helical grooves (41) move parallel from the intake end portion to the discharge end portion in the axial direction of the screw rotor (40) in accordance with the rotation of the screw rotor (40). Thus, by inclining the injection directions of oil as described above, rotational torque in such a direction that the helical grooves (41) are moved from the end portion on the intake end portion to the discharge end portion in the axial direction of the screw rotor (40), that is, torque for the rotation in the compression rotational direction can be imparted to the screw rotor (40).

In addition, in the first to third embodiments, although description is made of the single-screw compressors, this should not be construed restrictively. The present invention is also applicable to double-screw compressors.

Figure 8:
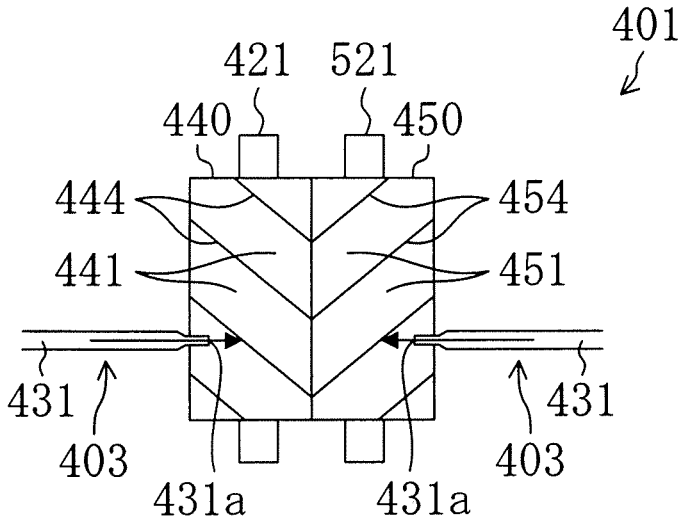
FIG. 8 are schematic explanatory views illustrating oil injection directions of a twin-screw compressor according to another embodiment.
Figure 8:
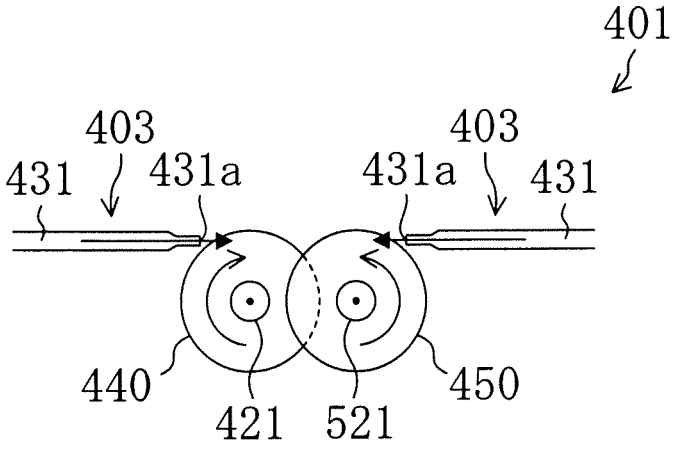

Specifically, as illustrated in FIG. 8, a twin-screw compressor (401) includes an male rotor (440) as a screw rotor, a female rotor (450) as another screw rotor, and a casing (not shown) for accommodating the male rotor (440) and the female rotor (450). Multiple helical walls (444, 444, . . . ) are formed on an outer peripheral surface of the male rotor (440), and a helical groove (441) is formed between each pair of the helical walls (444, 444). Similarly, multiple helical walls (454, 454, . . . ) are formed on an outer peripheral surface of the female rotor (450), and a helical groove (451) is formed between each pair of the helical walls (454, 454). The male rotor (440) and the female rotor (450) are arranged in the casing (not shown) such that drive shafts (421, 521) thereof are parallel to each other and helical walls (444, 454) thereof mesh with each other.

In this context, the twin-screw compressor (401) configured as described above includes male-side and female-side oil-supply mechanisms (403, 403) for supplying oil to the male rotor (440) and the female rotor (450), respectively. The male-side and female-side oil-supply mechanisms (403, 403) are arranged such that axial lines of first paths (431, 431) thereof are aligned straight with each other on a plane parallel to a plane including an axis of the male rotor (440) and an axis of the female rotor (450). Further, the axial lines of each of the first paths (431) is parallel to a tangential direction of the outer peripheral surface (outer peripheral surfaces of the helical grooves and bottom surfaces of the helical grooves) around the axial center of each of the rotors (440 (450)). That is, when viewed from the direction perpendicular to the plane including the axial center of the male rotor (440) and the axial center of the female rotor (450), the axial lines of the first paths (431) are respectively perpendicular to the axial centers of the rotors (440 (450)). In such configuration, oil is injected from a discharge hole (431*a*) of the male-side oil-supply mechanism (403) to the helical grooves (441) of the male rotor (440), and oil is injected from a discharge hole (431*a*) of the female-side oil-supply mechanism (403) to the helical grooves (451) of the female rotor (450). In this case, the oil-supply mechanisms (403) respectively inject oil in directions in which the rotors (440 (450)) are rotated, in other words, inject oil to a region in which the respective helical grooves (441 (451)) of the rotors (440 (450)) move in a direction of moving away from the discharge holes (431*a*).

Thus, as in the embodiments described above, the injection directions of oil injected from the discharge holes (431*a*, 431*a*) are directed to the region in which the helical grooves (441, 451) move in the direction of moving away from the respective discharge holes (431*a*, 431*a*), the region being in the male rotor (440) and the female rotor (450) which are rotated in the compression rotational direction. With this setting, oil injected into the compression chambers is prevented from hindering rotations of the male rotor (440) and the female rotor (450) at the time of compression. That is, mechanical loss of the twin-screw compressor (401) is prevented from increasing.

Further, when oil injected from the discharge holes (431*a*, 431*a*) respectively strikes the male rotor (440) and the female rotor (450), rotational torque for rotation in the compression rotational direction is imparted to the male rotor (440) and the female rotor (450). Thus, efficiency of the screw compressor (401) can be enhanced.

Figure 9:
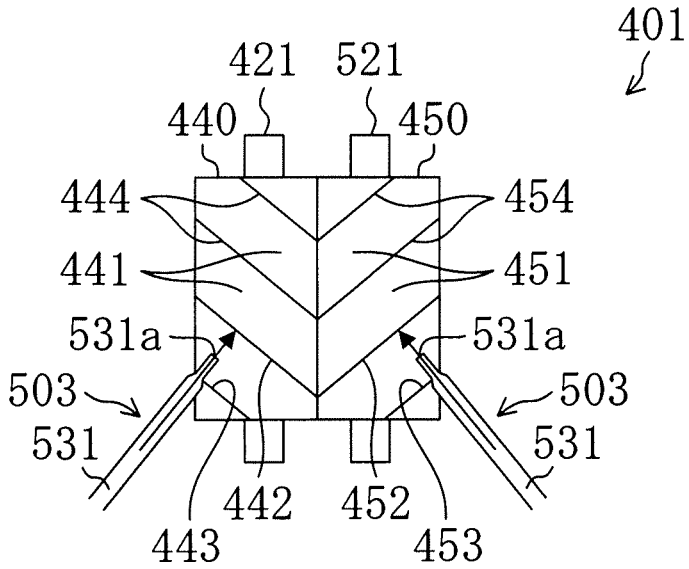
FIG. 9 are schematic explanatory views illustrating oil injection directions of a twin-screw compressor according to still another embodiment.
Figure 9:
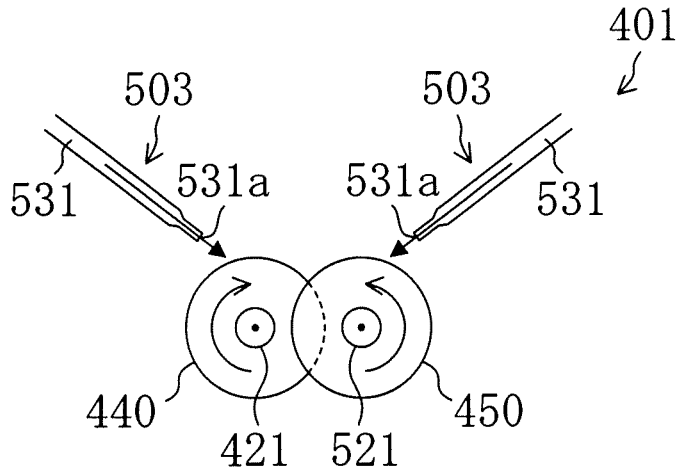

Further, as illustrated in FIG. 9, the twin-screw compressor (401) may be configured as follows: oil from a discharge hole (531*a*) of a male-side oil-supply mechanism (503) is injected to a first sidewall surface (442) of sidewall surfaces (442, 443) of the helical groove (441) of the male rotor (440), the first sidewall surface (442) being positioned on a forward side of an axial advance direction of the helical grooves (441); similarly, oil from a discharge hole (531*a*) of a female-side oil-supply mechanism (503) is injected to a first sidewall surface (452) of sidewall surfaces (452, 453) of the helical groove (451) of the female rotor (450), the first sidewall surface (452) being positioned on a forward side of an axial advance direction of the helical grooves (451).

As described above, by injecting oil to the first sidewall surfaces (442, 452), impact components in a direction of from intake-side end portions to discharge-side end portions in axial directions of the male rotor (440) and the female rotor (450) can be imparted to the male rotor (440) and the female rotor (450), respectively. That is, rotational torque for rotating the male rotor (440) and the female rotor (450) in the compression rotational direction can be imparted.

Figure 10:
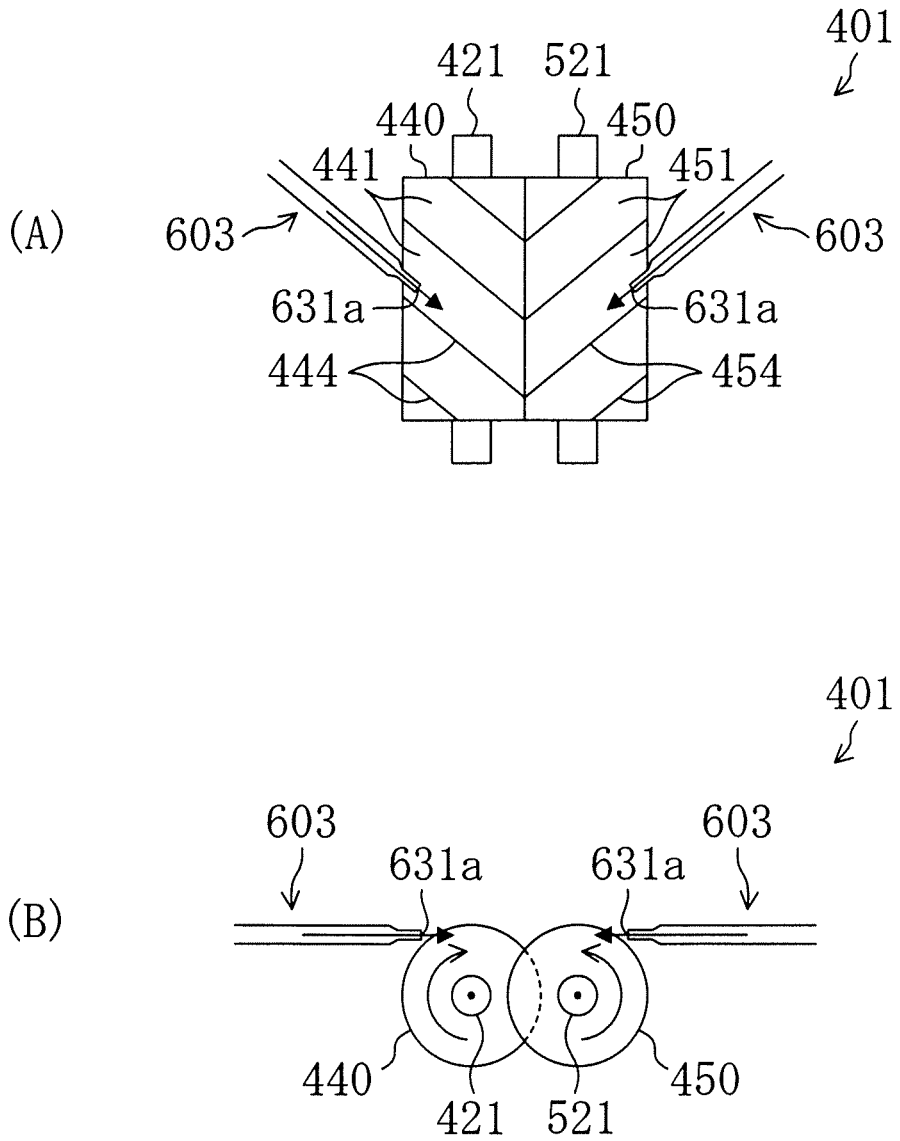
FIG. 10 are schematic explanatory views illustrating oil injection directions of a twin-screw compressor according to yet another embodiment.

Still further, as illustrated in FIG. 10, the twin-screw compressor (401) may be configured as follows: oil from a discharge hole (631*a*) of a male-side oil-supply mechanism (603) is injected to a starting-end side of the helical groove (441) along an extending direction of the helical groove (441) of the male rotor (440); similarly, oil from a discharge hole (631*a*) of a female-side oil-supply mechanism (603) is injected to a dead-end side of the helical groove (451) along an extending direction of the helical groove (451) of the female rotor (450).

As described above, by injecting oil from the respective discharge holes (631*a*, 631*a*) of the male-side and female-side oil-supply mechanisms (603, 603) to starting-end sides in the extending directions of the helical groove (441, 451), the oil can be injected in a direction along the compression rotational directions of the male rotor (440) and the female rotor (450). As a result, mechanical loss caused by injection of oil into compression chambers is prevented from increasing. In addition, rotational torque can be imparted to the screw rotor (440) and the female rotor (450) in directions of from the dead-end sides to the starting-end sides of the helical grooves (441, 451), and hence efficiency of the screw compressor (401) can be enhanced.

Note that, the embodiments described above are provided essentially for preferred illustration, and not for the purpose of limiting the present invention, application objects thereof, and the scope of use thereof.

INDUSTRIAL APPLICABILITY

As described above, the present invention is suitable to screw compressors in which oil or gas is supplied into compression chambers.

What is claimed is:

1. A screw compressor, comprising:

a screw rotor provided with multiple helical grooves; and a gate rotor provided with multiple gates meshing with the helical grooves to form at least one a compression chamber between at least one of the helical grooves and at least one of the gates, with the compression chamber being configured and arranged such that refrigerant taken-in from a starting-end side of the helical groove is compressed and discharged from a dead-end side of the helical groove; and an injection mechanism configured and arranged to inject oil or refrigerant from a discharge hole thereof into the compression chamber, the injection mechanism being further configured and arranged to inject oil or refrigerant to only a bottom wall surface and one sidewall surface of sidewall surfaces of the helical groove, with the one sidewall surface being formed on a forward side of an advance direction of the gate meshing with the helical groove.

2. A screw compressor, comprising:

a female rotor provided with multiple helical grooves;

a male rotor provided with multiple helical grooves meshing with the female rotor to form at least one a compression chamber between at least one of the helical grooves of the female rotor and at least one of the helical grooves of the male rotor, with the compression chamber being configured and arranged such that refrigerant taken-in from a starting-end side of the helical groove is compressed and discharged from a dead-end side of the helical groove; and an injection mechanism configured and arranged to inject oil or refrigerant from a discharge hole thereof into the compression chamber, the injection mechanism being further configured and arranged to inject oil or refrigerant to only a bottom wall surface and one sidewall surface of sidewall surfaces of the helical groove of the female rotor or the male rotor, with the one sidewall surface being formed on a forward side of an axial advance direction of the helical groove.

3. A screw compressor, comprising:

a screw rotor provided with multiple helical grooves; and a gate rotor provided with multiple gates meshing with the helical grooves to form at least one a compression chamber between at least one of the helical grooves and at least one of the gates, with the compression chamber being configured and arranged such that refrigerant taken-in from a side of a starting-end of the helical groove is compressed and discharged from a side of a dead-end of the helical groove; and an injection mechanism configured and arranged to inject oil or refrigerant from a discharge hole thereof into the compression chamber in a direction of an axial line passing through the discharge hole, the axial line being inclined relative to a straight line connecting the discharge hole and a rotation axis of the screw rotor, the axial line extending, when the helical groove is sectioned into two parts by the straight line intersecting the helical groove, toward one of the two parts of the helical groove including the starting-end, and the injection mechanism being further configured and arranged to inject oil or refrigerant along the helical groove in a direction from the dead-end to the starting-end of the helical groove.

4. A screw compressor, comprising:

a female rotor provided with multiple helical grooves;

a male rotor provided with multiple helical grooves meshing with the female rotor to form at least one a compression chamber between at least one of the helical grooves of the female rotor and at least one of the helical grooves of the male rotor, with the compression chamber being configured and arranged such that refrigerant taken-in from a side of a starting-end of the helical groove is compressed and discharged from a side of a dead-end of the helical groove; and an injection mechanism configured and arranged to inject oil or refrigerant from a discharge hole thereof into the compression chamber in a direction of an axial line passing through the discharge hole, the axial line being inclined relative to a straight line connecting the discharge hole and a rotation axis of the female rotor or the male rotor, the axial line extending, when the helical groove is sectioned into two parts by the straight line intersecting the helical groove of the female rotor or the male rotor, toward one of the two parts of the helical groove including the starting-end, and the injection mechanism being further configured and arranged to inject oil or refrigerant along the helical groove of the female rotor or the male rotor in a direction from the dead-end to the starting-end of the helical groove.

* * * * *